US011959671B2

(12) United States Patent
Cheng et al.

(10) Patent No.: US 11,959,671 B2
(45) Date of Patent: Apr. 16, 2024

(54) REFRIGERANT DISTRIBUTOR AND EVAPORATOR COMPRISING THE REFRIGERANT DISTRIBUTOR

(71) Applicant: McQuay Air Conditioning & Refrigeration (Wuhan) Co., Ltd., Hubei Province (CN)

(72) Inventors: Man Cheng, Hubei Province (CN); Feng Xu, Hubei Province (CN); Jie Zhou, Hubei Province (CN); Xin Ma, Hubei Province (CN); Xiong Luo, Hubei Province (CN)

(73) Assignee: McQuay Air Conditioning & Refrigeration (Wuhan) Co., Ltd., Hubei Province (CN)

( * ) Notice: Subject to any disclaimer, the term of this patent is extended or adjusted under 35 U.S.C. 154(b) by 310 days.

(21) Appl. No.: 17/334,232

(22) Filed: May 28, 2021

(65) Prior Publication Data

US 2021/0285701 A1 Sep. 16, 2021

Related U.S. Application Data

(63) Continuation of application No. PCT/CN2020/085869, filed on Apr. 21, 2020.

(30) Foreign Application Priority Data

Aug. 22, 2019 (CN) ..... 201910778507.2

(51) Int. Cl.
*F25B 39/02* (2006.01)
*F25B 41/40* (2021.01)

(52) U.S. Cl.
CPC ..... *F25B 39/028* (2013.01); *F25B 41/40* (2021.01)

(58) Field of Classification Search
CPC ..... F25B 39/028; F25B 41/40; F25B 41/42
See application file for complete search history.

(56) References Cited

U.S. PATENT DOCUMENTS 5,588,596 A * 12/1996 Hartfield ..... B01D 1/04 239/557
6,167,713 B1 * 1/2001 Hartfield ..... F25B 39/028 165/DIG. 171

(Continued)

FOREIGN PATENT DOCUMENTS

CN 202158699 3/2012
CN 204214172 3/2015

(Continued)

OTHER PUBLICATIONS

Japanese Patent Office, "Notice of Reasons for Refusal," issued in connection with Japanese Patent Application No. 2021-531535, dated Apr. 19, 2022, 9 pages.

(Continued)

*Primary Examiner* — Jonathan Bradford
(74) *Attorney, Agent, or Firm* — Hanley, Flight & Zimmerman, LLC

(57) ABSTRACT

A refrigerant distributor (4) includes: a box body (42); a refrigerant inlet (41) arranged on an upper surface (421) of the box body (42); liquid exit openings (46) evenly arranged on a lower surface (422) of the box body (42); and end plates arranged at both ends of the box body (42) in a length direction and enclosing the box body (42) from the two ends; wherein, in a height direction from the lower surface (422) of the box body (42) to the upper surface (421) and within a predetermined height range starting from the lower surface (422), a width of the box body (42) increases gradually; and a pre-distributor (3) is arranged inside the box body (42).

19 Claims, 9 Drawing Sheets

(56) References Cited

U.S. PATENT DOCUMENTS

| | | | | |
|---|---|---|---|---|
| 6,253,571 | B1 * | 7/2001 | Fujii | F25B 15/008 62/484 |
| 2010/0107676 | A1 | 5/2010 | Liu et al. | |
| 2016/0341457 | A1 * | 11/2016 | Christians | F28F 9/0207 |
| 2017/0254573 | A1 * | 9/2017 | Numata | F25B 39/028 |

FOREIGN PATENT DOCUMENTS

| | | |
|---|---|---|
| CN | 106482400 | 3/2017 |
| CN | 108709339 | 10/2018 |
| CN | 109489308 | 3/2019 |
| JP | 2019507862 | 3/2019 |
| WO | 2019078893 | 4/2019 |

OTHER PUBLICATIONS

IP Australia, "Examination report No. 1," issued in connection with Australian Patent Application No. 2020334589, dated Mar. 21, 2022, 3 pages.

Intellectual Property India, "Examination Report," issued in connection with Indian Patent Application No. 202147023869, dated Apr. 4, 2022, 4 pages.

International Searching Authority, "Written Opinion," issued in connection with PCT Application No. PCT/CN2020/085869, dated Jul. 20, 2020, 7 pages.

International Searching Authority, "International Preliminary Report on Patentability," issued in connection with PCT Application No. PCT/CN2020/085869, dated Feb. 17, 2022, 9 pages.

International Searching Authority, "International Search Report," issued in connection with PCT Application No. PCT/CN2020/085869, dated Jul. 20, 2020, 2 pages.

European Patent Office, "Extended European Search Report," issued in connection with European Patent Application No. 20855144.0, dated Jul. 4, 2022, 7 pages.

Intellectual Property Office of Singapore, Search Report and Written Opinion, issued in connection with Singapore Patent Application No. 11202105411U, dated Jan. 2, 2024, 9 pages.

European Patent Office, "Communication Pursuant to Article 94(3) EPC," issued in connection with European Patent Application No. 20855144.0, dated Feb. 13, 2024, 5 pages.

* cited by examiner

REFRIGERANT DISTRIBUTOR AND EVAPORATOR COMPRISING THE REFRIGERANT DISTRIBUTOR

CROSS REFERENCE TO RELATED APPLICATION

This patent arises from an application that is a continuation of International PCT Application No. PCT/CN2020/085869, filed on Apr. 21, 2020, and is hereby incorporated by reference in its entirety. Further, this patent claims priority to Chinese Patent Application 201910778507.2, which was filed on Aug. 22, 2019, which is hereby incorporated by reference in its entirety.

Technical Field

This disclosure relates to the field of air conditioning technologies, and in particular to a refrigerant distributor and an evaporator comprising the refrigerant distributor.

Background

A refrigeration system is mainly composed of a compressor, an evaporator, a condenser and a throttling device, in which the mainstream evaporator structure are of two types: a flooded type and a falling film type. With the increasing demand for energy saving and environmental protection, researches for water chillers have been turned to the direction of high performance and low refrigerant charge, and a flooded evaporator cannot effectively control the refrigerant charge of the water chiller on the premise of meeting high performance. Falling film evaporators are now widely used in central air conditioning refrigeration units. This type of heat exchangers has the advantages of small amount of refrigerant charge, compact structures, high heat transfer efficiencies, and stable heat exchange, etc.

In a falling film evaporator, a refrigerant distributor is a key component. In order to evenly distribute the refrigerant on an evaporating tube bundle, it is generally required that there is a sufficient pressure difference between inside and outside of the refrigerant distributor. For example, in a refrigeration system that uses high pressure refrigerant, such as R134a, etc., a pressure drop of the distributor often needs to reach 60 kpa or more, such that the refrigerant can be more evenly scattered on the heat exchange tube bundle.

Nowadays, in response to higher performance and environmental protection requirements at home and abroad, low-pressure refrigerant, such as R123 and R1233zd(e), are increasingly used in the air conditioning industry.

Under typical working conditions in which the evaporation temperature is 6° C. and the condensation temperature is 37° C., a pressure difference between the condenser and evaporator of the low-pressure refrigerant R1233zd(e) is only 23.1% of a pressure difference between a condenser and evaporator of a traditional refrigerant R134a.

It should be noted that the above description of the background is merely provided for clear and complete explanation of this disclosure and for easy understanding by those skilled in the art. And it should not be understood that the above technical solution is known to those skilled in the art as it is described in the background of this disclosure.

SUMMARY

It was found by the inventors that a low-pressure refrigerant is more prone to phase change due to a relatively small system pressure difference. Therefore, in a heat exchange system using the low-pressure refrigerant, requirements on pressure drop in a falling film evaporator refrigerant distributor have also changed dramatically. For example, the refrigerant throttled by a throttling device of the heat exchange system has a dryness of about 10%-20%, that is, the refrigerant entering a liquid inlet pipe of the evaporator is in gas and liquid phases, especially for a low-pressure refrigerant, a volume fraction of gaseous refrigerant can account for about 80% of the inlet refrigerant in gas liquid phases. The presence of gaseous refrigerant will cause excessive pressure drop in the distributor, which will have a relatively great impact on uniform distribution of the refrigerant in the falling film evaporator, thereby affecting a heat exchange effect of the refrigerant.

This disclosure provides a refrigerant distributor and an evaporator including the refrigerant distributor. A width of a box body of the refrigerant distributor increases gradually within a predetermined height range starting from a bottom of the box body. Hence, the gradually increasing width may effectively reduce a velocity of flow of the refrigerant in a gas-liquid mixture phase, facilitate separation of the gaseous refrigerant and the liquid refrigerant, reduce a pressure drop in the distributor, and facilitate uniform distribution of the liquid refrigerant in the distributor.

According to an aspect of the embodiments of this disclosure, there is provided a refrigerant distributor, including:

a box body;

a refrigerant inlet arranged on an upper surface of the box body;

liquid exit openings evenly arranged on a lower surface of the box body;

end plates arranged at both ends of the box body in a length direction and enclosing the box body from the two ends; and a pre-distributor arranged inside the box body, top of the pre-distributor being arranged under the upper surface, a length direction of the pre-distributor being in parallel with a length direction of the box body, and the pre-distributor comprising an inlet for allowing the refrigerant to flow into internal flow space of the pre-distributor, in a height direction from the lower surface to the upper surface of the box body and within a predetermined height range starting from the lower surface, a width of the box body increases gradually.

An advantage of the embodiments of this disclosure exists in that the width of the box body of the refrigerant distributor increases gradually within a predetermined height range starting from the bottom of the box body. Hence, the gradually increasing width may effectively reduce a velocity of flow of the refrigerant in a gaseous state, facilitate separation of the gaseous refrigerant and the liquid refrigerant, reduce a pressure drop in the distributor, and facilitate uniform distribution of the liquid refrigerant in the distributor. And the pre-distributor is arrange within the box body of the refrigerant distributor, in which the refrigerant in a gas-liquid mixture phase jetted from through holes in two side walls of the pre-distributor in the length direction collides with the inner side wall of the box body to form swirl flows, thereby promoting liquid drops falling off the gas flows and falling back to the bottom of the box body under the action of gravity.

With reference to the following description and drawings, the particular embodiments of this disclosure are disclosed in detail, and the principle of this disclosure and the manners of use are indicated. It should be understood that the scope of the embodiments of this disclosure is not limited thereto. The embodiments of this disclosure contain many alternations, modifications and equivalents within the scope of the terms of the appended claims.

BRIEF DESCRIPTION OF THE DRAWINGS

The drawings are included to provide further understanding of this disclosure, which constitute a part of the specification and illustrate the preferred embodiments of this disclosure, and are used for setting forth the principles of this disclosure together with the description. It is obvious that the accompanying drawings in the following description are some embodiments of this disclosure, and for those of ordinary skills in the art, other accompanying drawings may be obtained according to these accompanying drawings without making an inventive effort. In the drawings.

DETAILED DESCRIPTION

These and further aspects and features of this disclosure will be apparent with reference to the following description and attached drawings. In the description and drawings, particular embodiments of the disclosure have been disclosed in detail as being indicative of some of the ways in which the principles of the disclosure may be employed, but it is understood that the disclosure is not limited correspondingly in scope. Rather, the disclosure includes all changes, modifications and equivalents coming within the terms of the appended claims.

In the following description of this disclosure, for the convenience of description, a direction in which a central axis of an evaporator housing extends is referred to as "an axial direction", a radius direction centered on the axis is referred to as "a radial direction", a circumferential direction centered on the axis is referred to as "a circumferential direction", a direction from a lower surface of the distributor box body to an upper surface is referred to as "an upper direction", a direction opposite to the "upper direction" is referred to as "a down direction", sides of components of the refrigerant distributor and the evaporator towards the "upper direction" are referred to as "upper sides", and side opposite to the "upper sides" are referred to as "down sides". It should be noted that the above definitions of the upper direction, the lower direction, the upper sides and the lower sides are only for convenience of description, and do not limit orientations of the refrigerant distributor and the evaporator when they are used.

Embodiment 1

Figure 1:
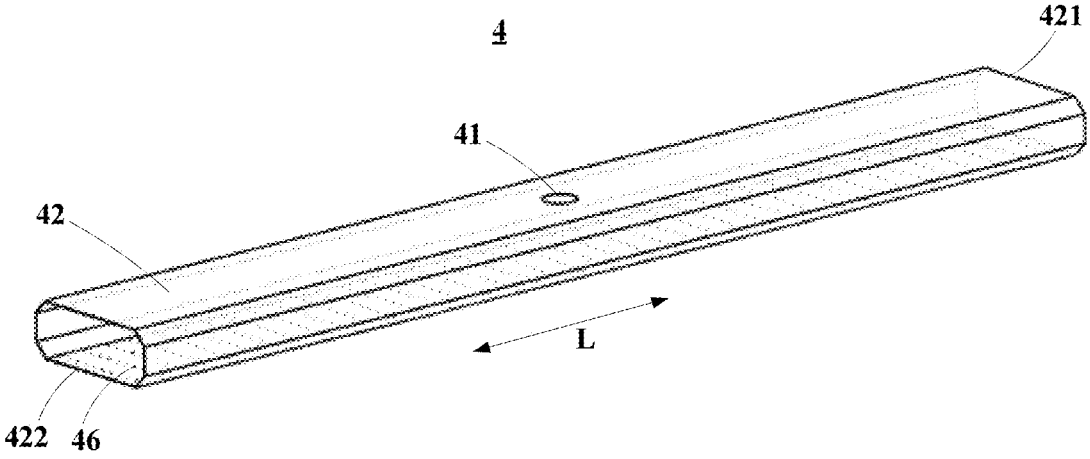
FIG. 1 is a perspective view of a refrigerant distributor of an embodiment of this disclosure.

The embodiment of this disclosure provides a refrigerant distributor. FIG. 1 is a perspective view of the refrigerant distributor of the embodiment of this disclosure.

As shown in FIG. 1, the refrigerant distributor 4 includes: a box body 42, a refrigerant inlet 41, liquid exit openings 46, and end plates (not shown in FIG. 1).

As shown in FIG. 1, the refrigerant inlet 41 is arranged on an upper surface 421 of the box body 42, and the liquid exit openings 46 are arranged on a lower surface 422 of the box body 42. The liquid exit openings 46 may be evenly distributed on the lower surface 422, and the liquid exit openings 46 are arranged through the lower surface 422, so that a liquid in the box body 42 may flow out from the liquid exit openings 46 and drip onto surfaces of heat exchange tubes; and the end plates may be arranged at both ends of the box body 42 in a length direction L and enclose the ends of the box body 42, so that an accommodation space for accommodating the refrigerant is formed within the box body 42.

In this embodiment, the refrigerant in a gas-liquid mixture phase may enter the box body 42 from the refrigerant inlet 41. In the box body 42, the gaseous refrigerant and the liquid refrigerant are separated, and the liquid refrigerant flows out through the liquid exit openings 46 of the lower surface 422, thereby distributing the refrigerant.

Figure 2A:
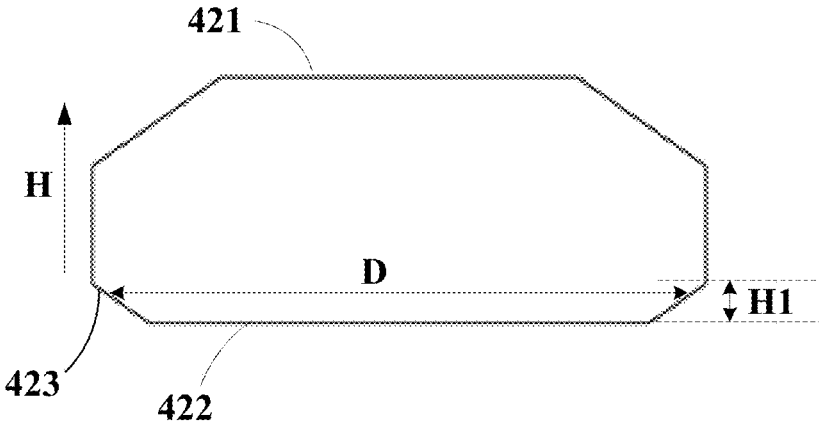
FIG. 2*a* is a schematic diagram of a cross section of a box body 42 perpendicular to a length direction L.

FIG. 2*a* is a schematic diagram of a cross section of the box body 42 perpendicular to the length direction L. As shown in FIG. 2*a*, in a height direction H from the lower surface 422 to the upper surface 421, a width D of the box body 42 increases gradually within a predetermined height range H1 starting from the lower surface 421. As the width D of the box body 42 increases gradually, the gradually increasing width may effectively reduce a velocity of flow of the gaseous refrigerant, facilitate separation of the gaseous refrigerant and the liquid refrigerant, reduce a pressure drop in the distributor, and facilitate even distribution of the liquid refrigerant in the distributor.

In this embodiment, as shown in FIG. 2*a*, a cross-sectional shape of the box body 42 is, for example, an octagon, and the octagonal cross-sectional shape has advantages as follows that: upper and lower ends of the octagonal shape are narrow, the middle is wide, and the refrigerant in two phases enters the box body 42, a space inside the box body is large, a speed of the gaseous refrigerant in the middle of the box body is effectively reduced, under the action of gravity, the liquid refrigerant is easier to be separated and settled down, forming a liquid level at the bottom of the box body, and the gaseous refrigerant entrains a part of the liquid refrigerant and moves upwards. As a cross section of the middle part of the box body is the largest, the speed of the gaseous refrigerant may be effectively reduced. After the gaseous refrigerant is separated from the liquid refrigerant, even distribution under the action of gravity is performed and the pressure drop is low. Therefore, it is suitable for heat exchange systems of large cooling capacities and heat exchange systems of low-pressure refrigerant. Furthermore, the octagonal shape has a large internal space and a large height, which may effectively prevent liquid entrainment when the gaseous refrigerant flows, and at the same time, wave motions due to the liquid refrigerant in the box body driven by high-speed fluid may also be prevented.

Furthermore, the octagonal shape has a high tolerance, and the eight corners are all obtuse angles, which is convenient for processing. Pre-distributors of various shapes may be arranged therein without being restricted by shapes of the pre-distributors. Heights of vertical sides at both sides of the octagonal shape may be set according to sizes and positions of components within the box body 42, and sizes of the upper and lower openings are not affected; in addition, when the refrigerant distributor 4 is arranged in a falling film evaporator, as the bottom of the octagonal shape is relatively wide, the refrigerant distributor 4 may cover as many heat exchange tube bundles as possible, which helps to even distribution of the refrigerant on the heat exchange tube bundles.

Figure 2B:
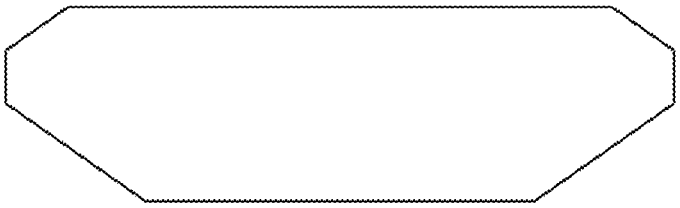
FIGS. 2*b*, 2*c*, 2*d*, 2*e*, 2*f* and 2*g* are respective schematic diagrams of different shapes of the box body 42 in a cross section perpendicular to the length direction L.

In this embodiment, in the octagonal shape shown in FIG. 2*a*, the vertical sides on both sides are relatively long, the upper opening is relatively smaller and the lower opening is relatively larger. This example is suitable for a case where internal components of the box body 42 are relatively tall. The octagonal shape of this embodiment is not limited thereto. For example, in the octagonal shape shown in FIG. 2*b*, the vertical sides on both sides are relatively short, the upper opening is relatively larger, and the lower opening is relatively smaller; or the upper opening and the lower opening of the octagonal shape may also be of the same size.

Figure 2C:
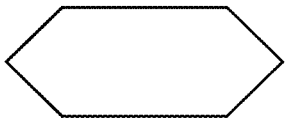
Figure 2D:
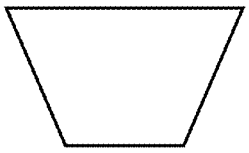
Figure 2E:
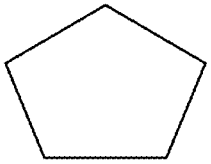
Figure 2F:
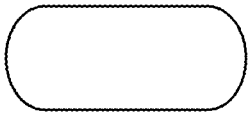
Figure 2G:
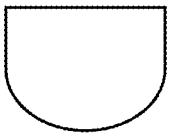

In addition, this embodiment may not be limited thereto, and the shape of the cross section of the box body 42 perpendicular to the length direction L may also be other figures composed of straight line segments and/or curved segments. For example, FIGS. 2*c*, 2*d*, 2*e*, 2*f* and 2*g* are respective schematic diagrams of different shapes of the box body 42 in a cross section perpendicular to the length direction L. In FIG. 2*c*, the shape of the cross section is hexagonal. In FIG. 2*d*, the shape of the cross section is of an inverted trapezoid. In FIG. 2*e*, the shape of the cross section is of a pentagon. In FIG. 2*f*, the shape of the cross section is that the upper and lower sides are straight segments, and the left and right sides are curved segments. In FIG. 2*g*, the shape of the cross section is that the lower end is of a curved segment, and the left and right sides and the upper end are of straight segments.

Figure 3A:
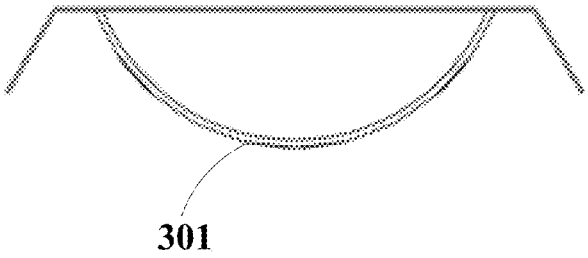
FIGS. 3*a*, 3*b* and 3*c* are respective schematic diagrams of different shapes of the box body 42 in a cross section perpendicular to the length direction L.
Figure 3B:
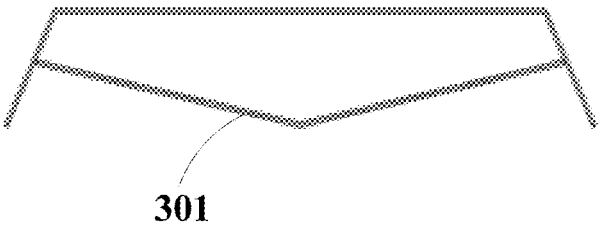
Figure 3C:
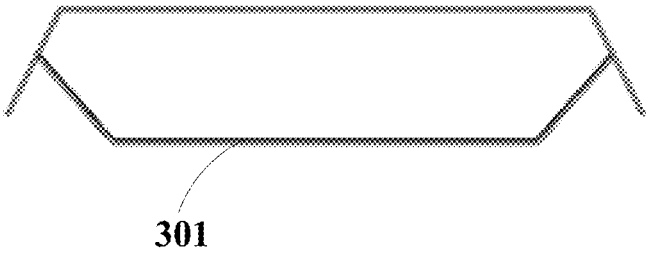

In this embodiment, the lower surface 422 of the box body 42 may be of a planar shape or a non-planar shape. The non-planar shape is, for example, an arc, an inverted cone, or an inverted trapezoid, etc. FIGS. 3*a*, 3*b* and 3*c* are respective schematic diagrams of different shapes of the box body 42 in a cross section perpendicular to the length direction L. In FIGS. 3*a*~3*c*, lower ends 301 have different shapes, and the shape of the lower end corresponds to the shape of the lower surface 422. FIG. 3*a*, FIG. 3*b* and FIG. 3*c* respectively correspond to cases where the lower surface 422 of the box body 42 is of an arc, an inverted cone, and an inverted trapezoid.

Figure 4:
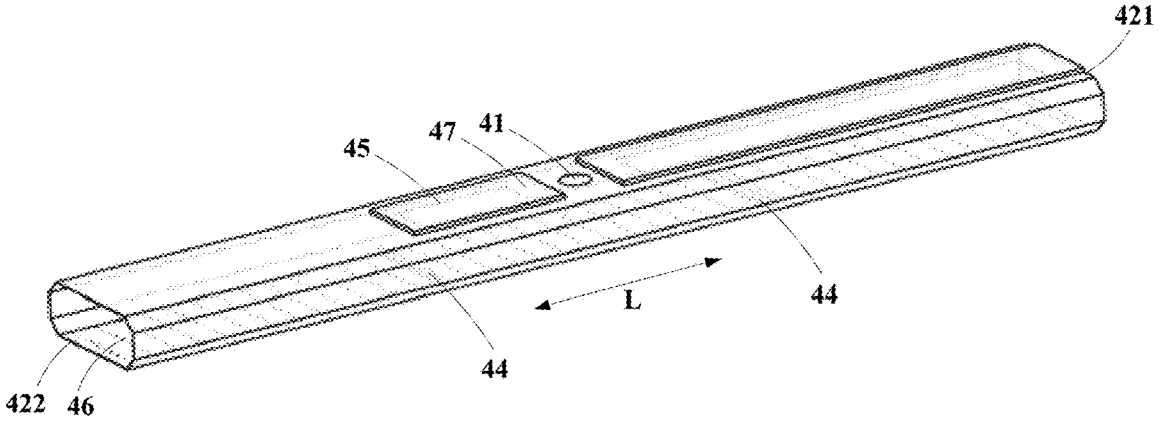
FIG. 4 is another perspective view of the refrigerant distributor of the embodiment of this disclosure.

FIG. 4 is another perspective view of the refrigerant distributor of the embodiment of this disclosure. FIG. 4 differs from FIG. 1 by that the refrigerant distributor 4 of FIG. 4 further includes a ventilation slot 45 and a wire mesh separator 47, in addition to all the structures in the refrigerant distributor 4 of FIG. 1.

As shown in FIG. 4, the ventilation slot 45 may be arranged on the upper surface 421 of the box body 42, and the wire mesh separator 47 may cover over the ventilation slot 45, an area of the wire mesh separator 47 being greater than or equal to that of the ventilation slot 45. Thus, the gaseous refrigerant in the box body 42 may be discharged from the box body 42 through the ventilation slot 45 and the wire mesh separator 47; and the wire mesh separator 47 may further filter the passing gaseous refrigerant to filter out the liquid refrigerant therein.

It should be noted that, as the refrigerant distributor 4 of FIG. 4 includes the ventilation slot 45, the upper surface of the box body 42 may not be of a non-planar shape, but may be of a planar shape. As the existence of the ventilation slot, the pressures inside and outside the box body 42 are identical, and the liquid refrigerant is subjected to gravity, and the liquid level may be freely adjusted in the box body 42. Therefore, the bottom surface of the box body 42 is of a planar shape, which may ensure that the speed of the fluid flowing out of the liquid exit openings on the bottom of the box body 42 is uniform.

As shown in FIG. 4, the refrigerant distributor 4 may further include support plates 44. The support plates 44 may be arranged inside the box body 42 and extend in a width direction of the box body 42. The support plates 44 are connected to the lower surface 422 and a side surface 423 adjacent to the lower surface 422 in a sealed manner. For example, the support plates 44 may be sealed with and connected to the lower surface 422 and the side surface 423 in a full-welded manner. The number of support plates 44 may be two or more, which may be evenly arranged in the length direction of the distribution box.

Figure 5:
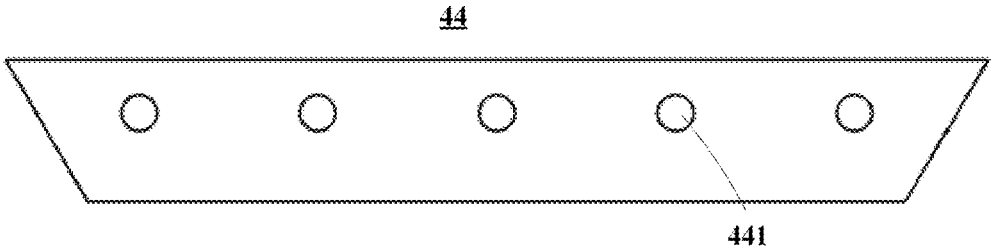
FIG. 5 is a schematic diagram of support plates 44 viewed in the length direction L.

FIG. 5 is a schematic diagram of one of the support plates 44 viewed in the length direction L. As shown in FIG. 5, through holes 441 are formed on upper parts of the support plate 44. The upper parts of the support plate 44 may refer to parts of the support plate 44 having height greater than a predetermined value, the predetermined value being, for example, a half a height of the support plate 44.

Due to the support plates 44, when the refrigerant distributor 4 is obliquely installed, the support plates 44 may prevent the refrigerant from flowing on the lower surface 422 of the box body 42, thereby avoiding serious tilting of the liquid level of the liquid refrigerant and avoiding severe dry liquid at parts of the lower surface 422. In addition, when the liquid level of the lower surface 422 has a certain height, the liquid refrigerant may flow through the through holes 441 in the support plates 44, thereby ensuring the fluidity of the liquid refrigerant.

It should be noted that the support plates 44 shown in FIG. 4 may also be arranged in the refrigerant distributor 4 of FIG. 1, and the above description of the support plates 44 is also applicable to the case where the support plates 44 are arranged in the refrigerant distributor 4 of FIG. 1.

In this embodiment, the refrigerant distributor 4 may further include a pre-distributor. Following description shall be given by taking that the pre-distributor is arranged in the refrigerant distributor 4 of FIG. 4 as an example, and the same description is also applicable to a case where the pre-distributor is arranged in the refrigerant distributor 4 of FIG. 1.

Figure 6:
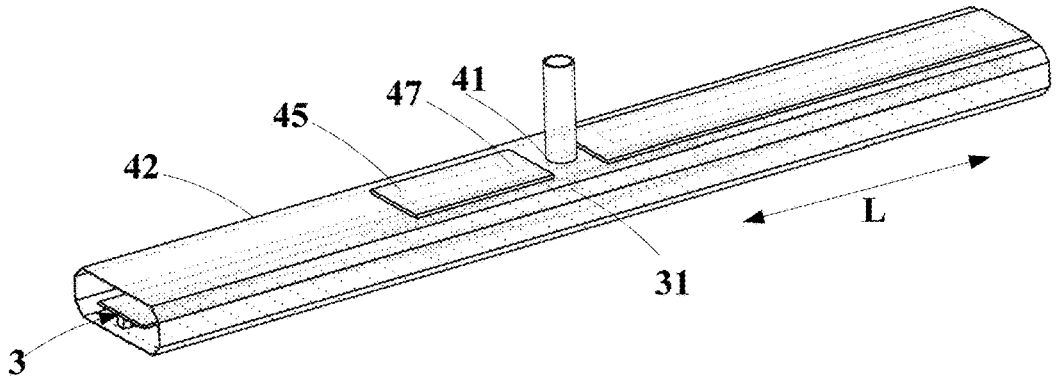
FIG. 6 is another perspective view of the refrigerant distributor of the embodiment of this disclosure.

FIG. 6 is another perspective view of the refrigerant distributor of the embodiment of this disclosure. As shown in FIG. 6, the refrigerant distributor 4 may further include:

a pre-distributor 3. The pre-distributor 3 is arranged within the box body 42 and is supported on upper ends of the support plates 44, and a length direction of the pre-distributor 3 is parallel to the length direction L of the box body 42. The pre-distributor 3 includes an inlet 31 for the refrigerant to flow in.

Figure 7:
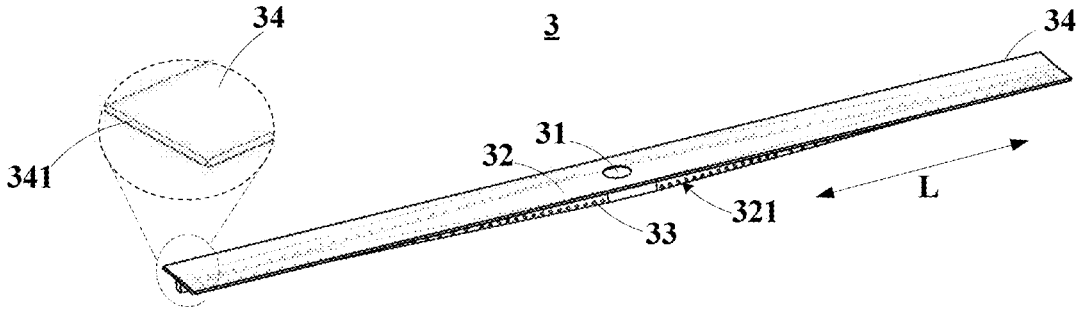
FIG. 7 is a perspective view of a pre-distributor 3 of the embodiment of this disclosure.
Figure 8:
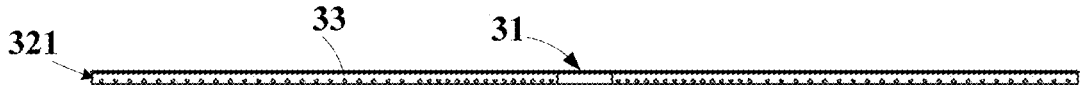
FIG. 8 is a side view of FIG. 7.
Figure 9:
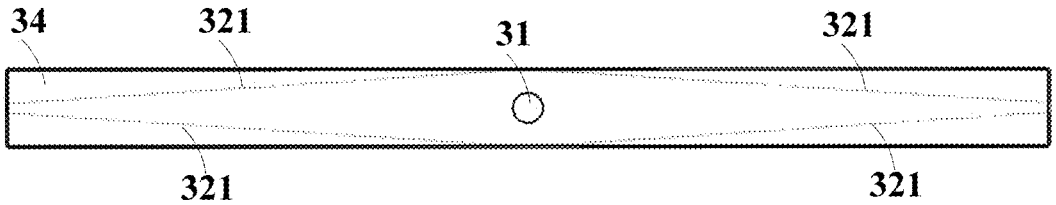
FIG. 9 is a top view of FIG. 7.

FIG. 7 is a perspective view of the pre-distributor 3 of the embodiment of this disclosure, FIG. 8 is a side view of FIG. 7, and FIG. 9 is a top view of FIG. 7.

As shown in FIG. 7, the pre-distributor 3 may be box-shaped. The pre-distributor 3 may include a distribution box 32 and a cover plate 34 covering an upper part of the distribution box 32. The inlet 31 for the refrigerant to flow in may be arranged in the cover plate 34. For example, the inlet 31 may be arranged at a central position of the cover plate 34 in the length direction.

As shown in FIG. 7, the distribution box 32 includes side walls 321 at both sides in the length direction, first pre-distributor openings 33 being formed in the side walls 321, and the number of the first pre-distributor openings 33 being multiple.

As shown in FIG. 7, distances between the first pre-distributor openings 33 and the inlet 31 may be greater than a predetermined threshold, thereby avoiding forming first pre-distributor openings 33 near the inlet 31. As the speed of the refrigerant near the inlet 31 is relatively high, the first pre-distributor openings 33 are formed away from the vicinity of the inlet 31, which is beneficial to uniform distribution of the liquid refrigerant in the distribution box 32.

As shown in FIG. 7, a shape of the first pre-distributor openings 33 is circular. However, this embodiment is not limited thereto, and the first pre-distributor openings 33 may also be of other shapes, such as polygonal, and oval, etc.

In this embodiment, the cover plate 34 and the distribution box 32 are hermetically connected. As shown in FIG. 7, the area of the cover plate 34 is larger than the area of the bottom of the distribution box 32. In addition, a shape of the cover plate 34 may identical to or different from the shape of the bottom of the distribution box 32.

In this embodiment, a bending portion 341 bent toward the distribution box 32 is formed at edges of the cover plate 34. The cover plate 34 is beneficial to that the liquid refrigerant is not subjected to an upward air flow in flowing out of the first pre-distributor openings 33; and furthermore, the bending portion 341 is advantageous to the liquid refrigerant collected on the surface of the cover plate 34 to flow down.

As shown in FIGS. 7 and 8, in the height direction, distances from at least a part of the first pre-distributor openings 33 to the bottom of the distribution box 32 are less than a half of the height of the distribution box 32 and are greater than zero. That is, at least a part of the first pre-distributor openings 33 are arranged in the lower halves of the side walls 321. Therefore, it is advantageous to the liquid refrigerant to flow out of the first pre-distributor openings 33. In addition, settings of positions of the first pre-distributor openings 33 may not be limited thereto.

In this embodiment, when the cross-sectional shape of the box body 42 of the refrigerant distributor 4 is of an octagonal shape, in the height direction, at least a part of the first pre-distributor openings 33 may be located within the height range of the vertical sides on both sides of the octagonal shape, hence, the refrigerant in a gas-liquid mixture phase jetted out of the through holes on the two side walls of the pre-distributor in the length direction collides with the inner side walls of the box body 42, thereby forming upper and lower swirls in the box body 42, promoting droplets to fall off from the air flow and fall back to the bottom of the box body 42 under the action of gravity, and facilitating separation of the liquid refrigerant and the gaseous refrigerant.

In this embodiment, as shown in FIG. 8, the closer to the inlet 31, the larger the sizes and/or the greater the distribution density of the first pre-distributor openings 33, thereby enabling the liquid refrigerant to uniformly flow in the first pre-distributor openings 33.

In this embodiment, as shown in FIG. 8, in the length direction L, the distribution of the first pre-distributor openings 33 is asymmetrical with respect to the inlet 31, that is, in FIG. 8, multiple first pre-distributor openings 33 are distributed asymmetrically at left and right sides of the inlet 31. For example, in the length direction L, with the inlet 31 as the center, the first pre-distributor openings 33 at one side (such as the left side) and the other side (such as the right side) of the inlet 31 may be staggered relative to the inlet 31.

In this embodiment, as shown in FIG. 9, the shape of the distribution box 32 in a cross section parallel to the cover plate 34 is of an octagon.

Figure 10:
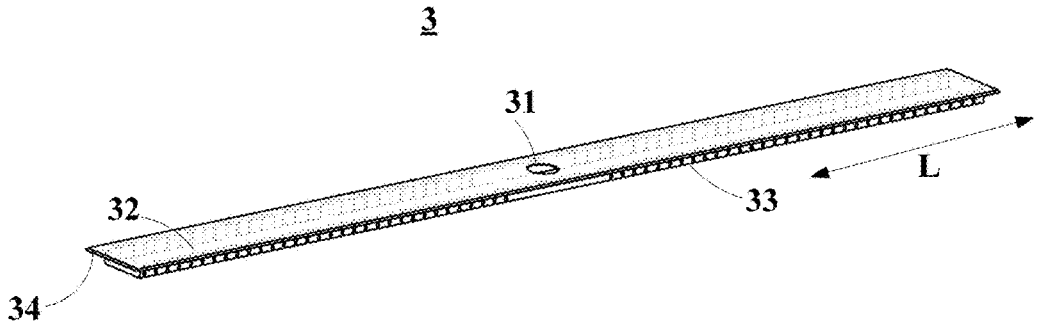
FIG. 10 is another perspective view of the pre-distributor 3 of the embodiment of this disclosure.
Figure 11:
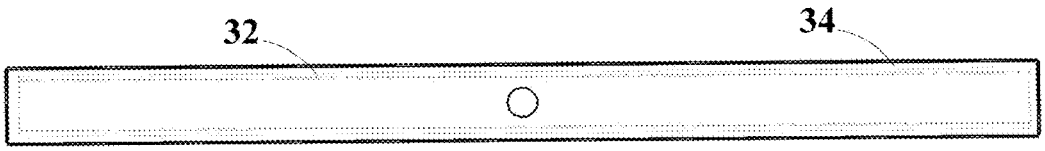
FIG. 11 is a top view of FIG. 10.
Figure 12:
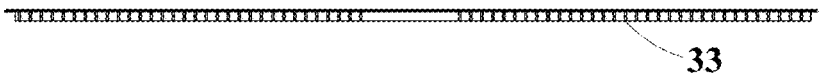
FIG. 12 is a side view of FIG. 10.

FIG. 10 is another perspective view of the pre-distributor 3 of the embodiment of this disclosure, FIG. 12 is a side view of FIG. 10, and FIG. 11 is a top view of FIG. 10.

As shown in FIG. 10 and FIG. 11, the shape of the distribution box 32 of the pre-distributor 3 in a cross section parallel to the cover plate 34 is of a quadrilateral; however, this embodiment is not limited thereto, and the shape of the distribution box 32 of the pre-distributor 3 on the cross section parallel to the cover plate 34 may also be another figures composed of straight line segments.

As shown in FIGS. 10 and 12, the shapes of the first pre-distributor openings 33 of the pre-distributor 3 are of long strips.

In a variant implementation of this embodiment, the pre-distributor may be cylindrical.

Figure 13:
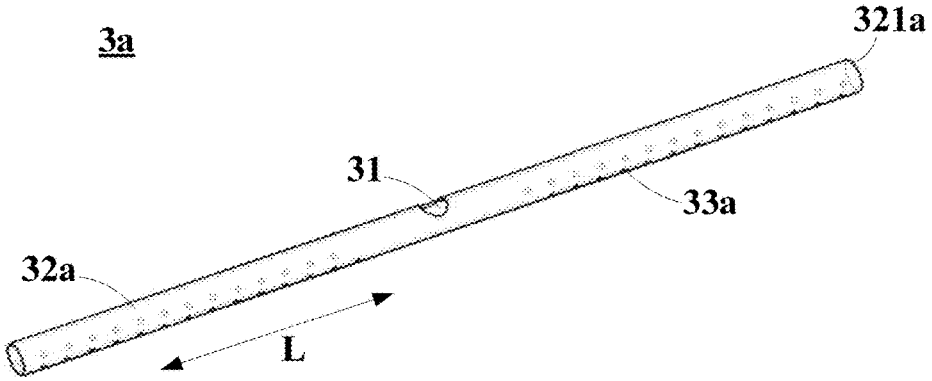
FIG. 13 is a further perspective view of the pre-distributor of the embodiment of this disclosure.
Figure 14:
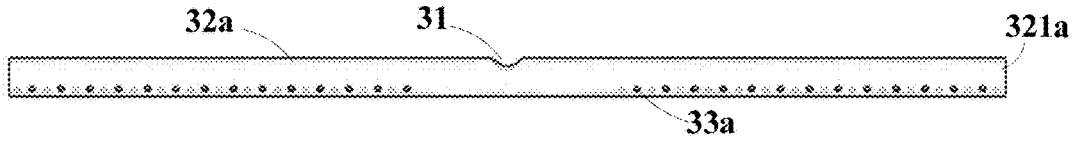
FIG. 14 is a side view of FIG. 13.

FIG. 13 is a further perspective view of the pre-distributor of the embodiment of this disclosure, and FIG. 14 is a side view of FIG. 13.

As shown in FIG. 13, the pre-distributor 3*a* includes a distribution pipe 32*a*. The inlet 31 may be arranged at the top of a pipe wall 321*a* of the distribution pipe 32*a*, second pre-distributor openings 33*a* being formed in the pipe wall 321*a*.

In the height direction, distances from at least a part of the second pre-distributor openings 33*a* and a bottom of the distribution pipe 32*a* are less than a half of a height of the distribution pipe 32*a* and greater than zero. That is, at least a part of the second pre-distributor openings 33*a* are provided in the lower half of the pipe wall 321*a*. Therefore, it is advantageous for the liquid refrigerant to flow out of the second pre-distributor openings 33*a*. In addition, settings of the positions of the second pre-distributor openings 33*a* may not be limited thereto.

As shown in FIGS. 13 and 14, the shapes of the second pre-distributor openings 33*a* are circular; however, this embodiment may not be limited thereto, and the second pre-distributor openings 33*a* may also be of other shapes, such as polygonal, and elliptical, etc.

In this embodiment, the closer to the inlet 31, the larger the sizes and/or the greater the distribution density of the second pre-distributor openings 33*a*, thereby enabling the liquid refrigerant to uniformly flow in the second pre-distributor openings 33*a*.

In this embodiment, in the length direction L, the distribution of the second pre-distributor openings 33*a* is asymmetrical with respect to the inlet 31, that is, in FIG. 14, multiple second pre-distributor openings 33*a* are distributed asymmetrically at left and right sides of the inlet 31. For example, in the length direction L, with the inlet 31 as the center, the second pre-distributor openings 33*a* at one side (such as the left side) and the other side (such as the right side) of the inlet 31 may be staggered relative to the inlet 31.

Figure 15:
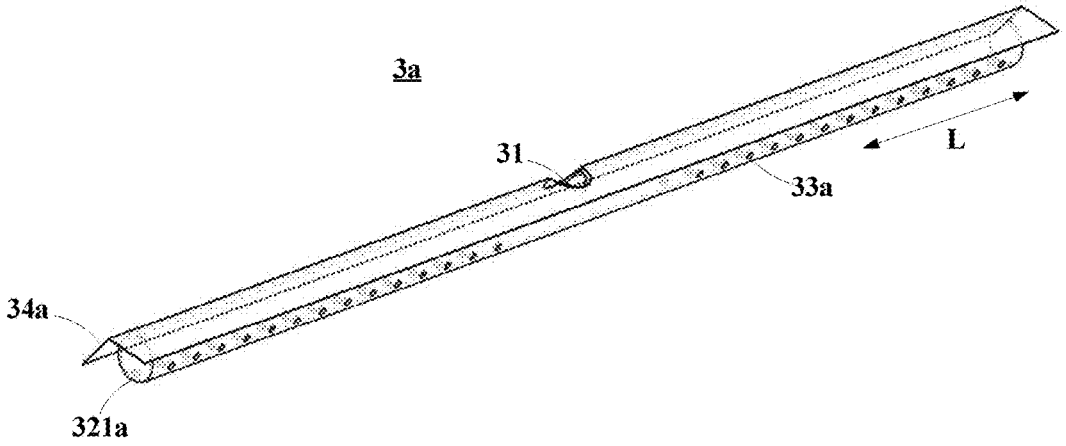
FIG. 15 is still another perspective view of the pre-distributor 3*a* of the embodiment of this disclosure.
Figure 16:
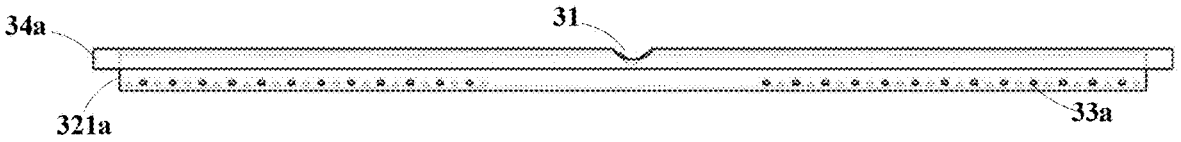
FIG. 16 is a side view of FIG. 15.

FIG. 15 is still another perspective view of the pre-distributor 3*a* of the embodiment of this disclosure, and FIG. 16 is a side view of FIG. 15.

A difference between FIG. 15 and FIG. 13 is that the pre-distributor 3*a* of FIG. 15 further includes a second cover plate 34*a*. The second cover plate 34*a* is arranged on the upper part of the distribution pipe 32*a*, and an area of the second cover plate 34*a* is larger than a cross-sectional area of the distribution pipe 32*a* parallel to the length direction L. The second cover plate 34*a* is beneficial to that the liquid refrigerant is not subjected to an upward air flow in flowing out of the second pre-distributor openings 33*a*.

In addition, the second cover plate 34*a* may include a bending structure inclined with respect to the height direction, the bending structure being advantageous to the liquid refrigerant collected on the surface of the second cover plate 34*a* to flow down.

In addition, reference may be made to related description of FIGS. 13 and 14 for description of the second pre-distributor openings 33*a* in the pre-distributor 3*a* of FIGS. 15 and 16.

In addition, in FIG. 13, FIG. 14, FIG. 15 and FIG. 16, distances between the second pre-distributor openings 33*a* and the inlet 31 may be greater than the predetermined threshold, thereby avoiding formation of second pre-distributor openings 33*a* near the inlet 31.

According to this embodiment, when the pre-distributor 3 does not exist in the box body 42 of the refrigerant distributor 4, the refrigerant in a gas-liquid mixture phase enters the box body 42 through the refrigerant inlet 41. As the width of the box body 42 gradually increases, the velocity of flow of the gaseous refrigerant may be effectively reduced, which is beneficial to the separation of the gaseous refrigerant and the liquid refrigerant, reduces a pressure drop in the distributor, and is beneficial to uniform distribution of the liquid refrigerant in the distributor. The liquid refrigerant in the box body 42 flows out through the liquid exit openings 46 on the lower surface 422 of the box body 42.

When the box body 42 of the refrigerant distributor 4 includes the pre-distributor 3, the gas-liquid mixed refrigerant enters the pre-distributor 3 (or 3*a*) through a liquid inlet pipe which is connected to the inlet 31 of the pre-distributor 3 (or 3*a*) and passes through the upper surface 421 of the box body 42 through the refrigerant inlet 41. The mixed refrigerant is distributed in the length direction in the pre-distributor 3 (or 3*a*), and the refrigerant in a mixed phase is initially uniformly distributed, flows out of the pre-distributor 3 (or 3*a*) through the first pre-distributor openings 33 (or the second pre-distributor openings 33*a*) and enters the box body 42; the refrigerant in the box body 42 undergoes gas-liquid separation, and as the width of the box body 42 gradually increases, the velocity of flow of the gaseous refrigerant is effectively reduced, which is beneficial to the separation of the gaseous refrigerant and the liquid refrigerant and reduction of the pressure drop in the distributor, and is beneficial to uniform distribution of the liquid refrigerant in the distributor. At the same time, the refrigerant in a gas-liquid mixture phase jetted from through holes 33 (or 33*a*) in two side walls of the pre-distributor 3 in the length direction collides with the inner side wall of the box body to form swirl flows, thereby promoting liquid drops falling off the gas flows and falling back to the bottom of the box body under the action of gravity. And the liquid refrigerant in the box body 42 flows out through the liquid exit openings 46 on the lower surface 422 of the box body 42.

Figure 17:
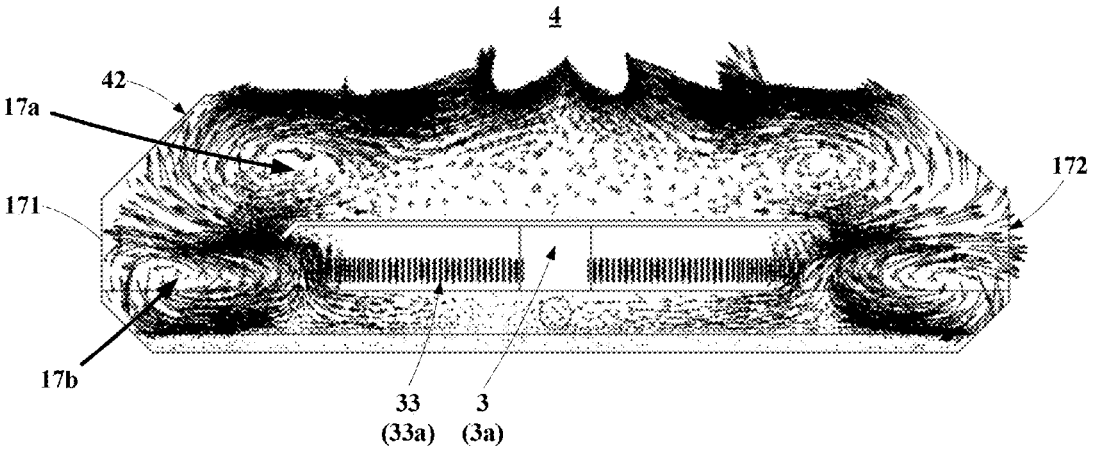
FIG. 17 is a schematic diagram of flow field distribution of the refrigerant in the box body 42 of this embodiment.

FIG. 17 is a schematic diagram of flow field distribution of the refrigerant in the box body 42 of this embodiment. As shown in FIG. 17, when the cross-sectional shape of the box body 42 of the refrigerant distributor 4 is of an octagon (such as the octagon shown in FIG. 2*a*), in the height direction H, at least a part of the first pre-distributor openings 33 or the second pre-distributor openings 33*a* may be located within a height range of vertical sides 171, 172 on both sides of the octagonal shape.

As shown in FIG. 17, when the high-speed gas-liquid mixed refrigerant flows out of the first pre-distributor openings 33 or the second pre-distributor openings 33*a* of the pre-distributor 3 or 3*a*, it collides with the vertical walls 171, 172 on both sides of the octagonal shape and is guided by upper and lower slopes to form upper and lower swirling flows 17*a* and 17*b*. In the swirling flows 17*a* and 17*b* formed by the gas-liquid mixed refrigerant, a direction of motion of the gaseous refrigerant changes sharply, while droplets of the liquid refrigerant are large in mass and inertia, and is subjected to greater gravity, so it falls off easily from the gaseous refrigerant and flows to the bottom of the box body 42 along the vertical sides 171 and 172 on both sides, thereby improving an effect of gas-liquid separation of the refrigerant.

In addition, due to the existence of the upper and lower swirling flows 17*a* and 17*b*, the gas-liquid mixed refrigerant stays in the box body 42 for a longer time, and the refrigerant droplets entrained by the high-speed air flow are more likely to fall back to the bottom of the box body under the action of inertia and gravity, and are difficult to flow out from the ventilation slot on the upper part of the box body 42, thereby reducing the risk of liquid entrainment.

Embodiment 2

The embodiment of this disclosure provides an evaporator, including the refrigerant distributor described in Embodiment 1.

Figure 18:
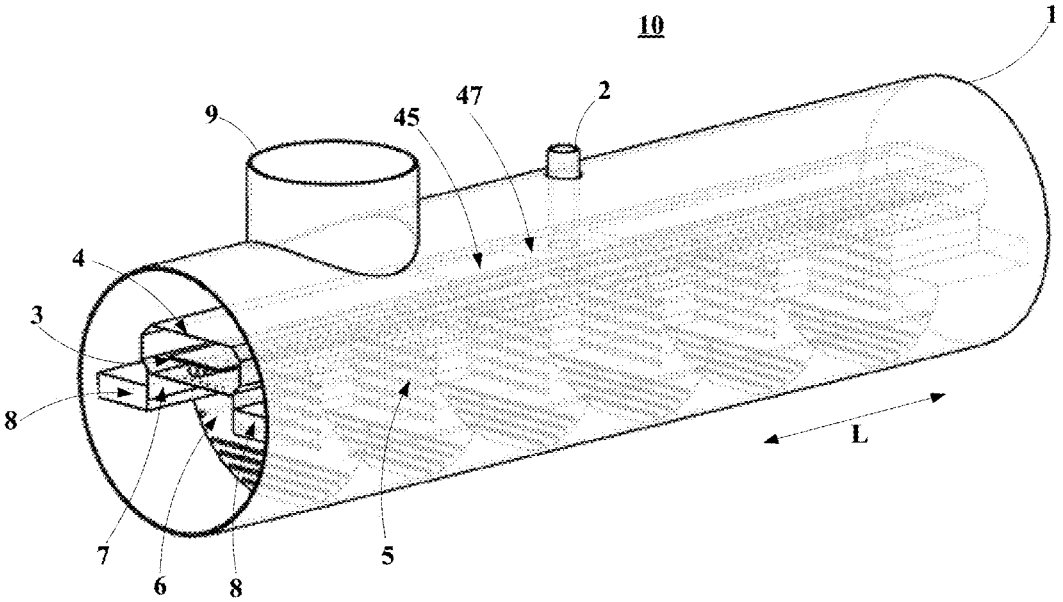
FIG. 18 is a perspective view of the evaporator of Embodiment 2 of this disclosure.
Figure 19:
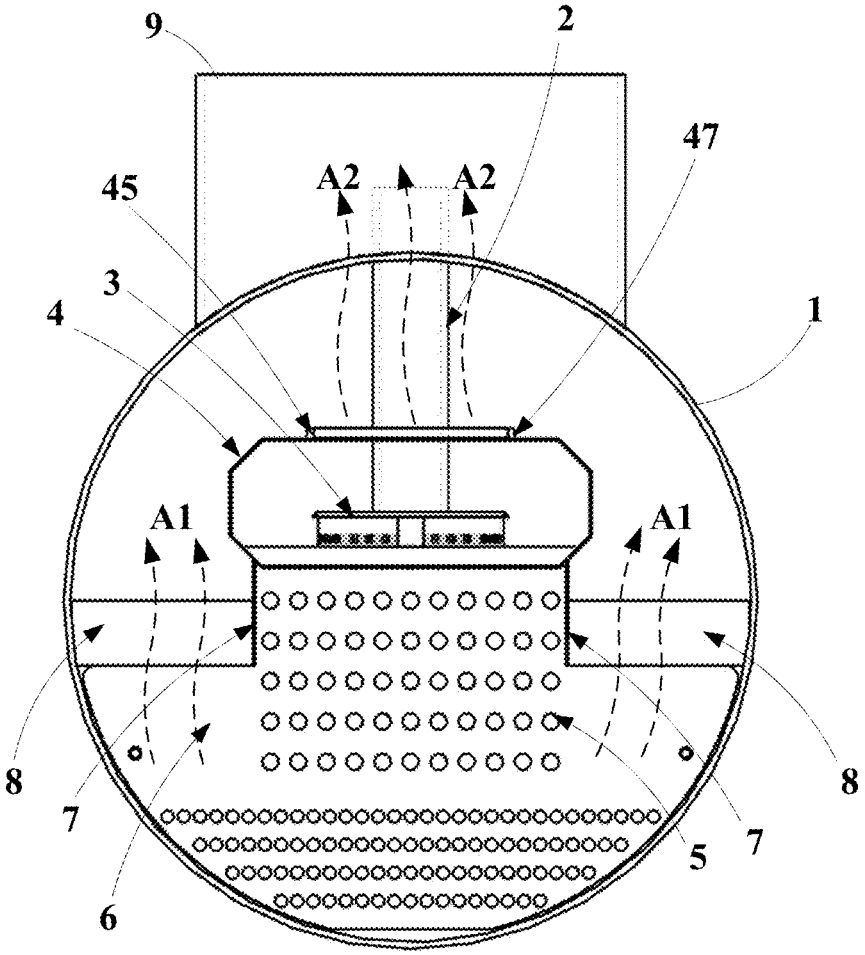
FIG. 19 is a cross-sectional view of FIG. 18 in a direction perpendicular to the length direction.

FIG. 18 is a perspective view of the evaporator of Embodiment 2 of this disclosure, and FIG. 19 is a cross-sectional view of FIG. 18 in a direction perpendicular to the length direction. The evaporator is, for example, a falling film evaporator.

As shown in FIG. 18 and FIG. 19, the evaporator 10 includes a refrigerant distributor 4, an evaporator housing 1, a liquid inlet pipe 2, an air intake opening 9 and a heat exchange tube bundle 5.

As shown in FIG. 18 and FIG. 19, the liquid inlet pipe 2 passes through the evaporator housing 1 and is connected to the refrigerant inlet 41. For example, the liquid inlet pipe 2 enters the refrigerant distributor 4 through the evaporator housing 1 and is connected to the inlet 31 of the pre-distributor 3 in the refrigerant distributor 4 to inject the refrigerant into the pre-distributor 3; or, in a case where there is no pre-distributor 3, the liquid inlet pipe 2 enters the refrigerant distributor 4 through the evaporator housing 1 and injects the refrigerant into the box body 42 of the refrigerant distributor 4.

As shown in FIG. 18 and FIG. 19, the refrigerant distributor 4 is located over the heat exchange tube bundle 5, and the liquid refrigerant flowing out from the refrigerant distributor 4 flows onto the heat exchange tube bundle 5 and exchanges heat with the heat exchange tube bundle.

As shown in FIG. 18 and FIG. 19, the air intake opening 9 is arranged on the top of the evaporator housing 1, and the gaseous refrigerant in the evaporator housing 1 is discharged through the air intake opening 9. The air intake opening 9 may be, for example, connected to a gas replenishing hole of a compressor.

As shown in FIG. 18 and FIG. 19, the evaporator 10 further includes a heat exchange tube bundle support plate 6, side baffles 7 and a mist catcher 8.

In this embodiment, the heat exchange tube bundle support plate 6 may be located under the refrigerant distributor 4 and used for supporting the heat exchange tube bundle 5. For example, the heat exchange tube bundle 5 passes through the heat exchange tube bundle support plate 6. The side baffles 7 may be located below the refrigerant distributor 4 and on both sides of the heat exchange tube bundle 5. The mist catcher 8 is located between the side baffles 7 and the evaporator housing 1 in the width direction, and is supported by the heat exchange tube bundle support plate 6 in the height direction. The mist catcher 8 may be, for example, a wire mesh separator.

In this embodiment, as shown in FIGS. 18 and 19, the gas-liquid mixed refrigerant enters the refrigerant distributor 4 through the liquid inlet pipe 2, the gas-liquid mixed refrigerant is separated in the refrigerant distributor 4, the separated gaseous refrigerant flows out from the ventilation slot 45 on the top of the box body 42 of the refrigerant distributor 4 and the wire mesh separator 47, and the liquid refrigerant falls into the lower surface 422 of the box body 42 (not shown in FIG. 18 and FIG. 19) under the action of gravity, and flows out to the heat exchange tube bundle 5 for membrane heat exchange after being evenly distributed in the liquid exit openings 46 (not shown in FIG. 18 and FIG. 19). The gaseous refrigerant produced by heat exchange evaporation entrains some liquid droplets, flows through passages between the side baffles 7 and the evaporator housing 1, and interacts with the mist catcher 8 arranged on the heat exchange tube bundle support plate 6 and between the side baffles 7 and the evaporator housing 1, and the liquid refrigerant entrained in the gaseous refrigerant is filtered. Finally, the gaseous refrigerant generated by the heat exchange in the evaporator and the gaseous refrigerant flowing out of the ventilation slot 45 of the distributor 4 and the wire mesh separator 47 flow out from the air intake opening 9 of the evaporator under a suction action of the compressor.

In FIG. 19, the gaseous refrigerant generated by the heat exchange in the evaporator is shown by a dotted arrow A1, and the gaseous refrigerant flowing out of the ventilation slot 45 of the distributor 4 and the wire mesh separator 47 is shown by a dotted arrow A2. As shown in FIG. 19, the gas flow passages of the gaseous refrigerant indicated by the dotted arrow A1 and the dotted arrow A2 do not interfere with each other, and the gas-liquid separation effect is improved due to the discharge of the gas.

In this embodiment, due to the use of the refrigerant distributor of this disclosure, the liquid refrigerant may be more evenly distributed to the heat exchange tube bundle, so the heat exchange efficiency of the evaporator is improved.

The evaporator of this embodiment may be used in a heat exchange system, and due to the use of the evaporator of this embodiment, the heat exchange efficiency of the heat exchange system may be improved, and the risk of liquid entrainment of the evaporator may be effectively controlled, which is conducive to the use of low-pressure refrigerant in the heat exchange system.

This disclosure is described above with reference to particular embodiments. However, it should be understood by those skilled in the art that such a description is illustrative only, and not intended to limit the protection scope of the present disclosure. Various variants and modifications may be made by those skilled in the art according to the principle of the present disclosure, and such variants and modifications fall within the scope of the present disclosure.

The invention claimed is:

1. A refrigerant distributor, characterized in that the refrigerant distributor (4) comprises:

a box body (42);

a refrigerant inlet (41) arranged on an upper surface (421) of the box body (42);

liquid exit openings (46) evenly arranged on a lower surface (422) of the box body (42);

end plates arranged at two ends of the box body (42) in a length direction and enclosing the box body (42) from the two ends; and a pre-distributor (3, 3*a*) arranged inside the box body (42), the top of the pre-distributor (3, 3*a*) being arranged under the upper surface (421), a length direction of the pre-distributor (3, 3*a*) being in parallel with a length direction of the box body (42), and the pre-distributor (3, 3*a*) comprising an inlet (31) for allowing the refrigerant to flow into an internal flow space of the pre-distributor (3, 3*a*), wherein, in a height direction from the lower surface (422) to the upper surface (421) of the box body (42) and within a predetermined height range starting from the lower surface (422), a width of the box body (42) increases, side surfaces of the box body (42) are closed;

the pre-distributor (3, 3*a*) comprises a distribution box (32) or a distribution pipe (32*a*), the refrigerant flows into the distribution box (32) or the distribution pipe (32*a*) through the inlet (31); and the pre-distributor (3, 3*a*) is arranged above the lower surface (422) of the box body (42), and the liquid exit openings (46) are distributed on a part of the lower surface (422) of the box body (42) located below the pre-distributor (3, 3*a*).

2. The refrigerant distributor according to claim 1, wherein the refrigerant distributor further comprises:

a ventilation slot (45) arranged on the upper surface (421) of the box body (42); and a wire mesh separator (47) covering over the ventilation slot (45), an area of the wire mesh separator (47) being greater than or equal to an area of the ventilation slot (45).

3. The refrigerant distributor according to claim 2, wherein, a cross-sectional shape of the box body (42) in a direction perpendicular to the length direction is octagonal.

4. The refrigerant distributor according to claim 1, wherein the refrigerant distributor further comprises:

support plates (44) arranged inside the box body (42) and extending in a width direction of the box body (42), the support plates (44), the lower surface (422) and a side surface (423) adjacent to the lower surface being connected in a sealed manner, and the number of the support plates (44) being at least two, wherein the pre-distributor (3) is supported on upper ends of the support plates (44).

5. The refrigerant distributor according to claim 4, wherein, upper parts of the support plates (44) comprise through holes (441).

6. The refrigerant distributor according to claim 1, wherein the pre-distributor (3) comprises a distribution box (32) and a cover plate (34) covering an upper part of the distribution box (32), the inlet (31) being arranged in the cover plate (34), the distribution box (32) comprising side walls (321) at both sides along the length direction, first pre-distributor openings (33) being formed in the side walls (321), and distances between the first pre-distributor openings (33) and the inlet (31) being greater than a predetermined threshold, and in the height direction, distances between at least a part of the first pre-distributor openings (33) to a bottom of the distribution box (32) being less than a half of a height of the distribution box (32) and greater than zero.

7. The refrigerant distributor according to claim 6, wherein, an area of the cover plate (34) is larger than an area of the bottom of the distribution box (32), and a bending portion (341) bent toward the distribution box (32) is formed at an edge of the cover plate (34).

8. The refrigerant distributor according to claim 6, wherein, a cross-sectional shape of the distribution box (32) parallel to the cover plate (34) is octagonal, quadrilateral or of other figures formed by straight line segments.

9. The refrigerant distributor according to claim 6, wherein, the closer to the inlet (31), the larger sizes and/or the larger distribution density of the first pre-distributor openings (33).

10. The refrigerant distributor according to claim 6, wherein, in the length direction, the first pre-distributor openings (33) are asymmetric with respect to the inlet (31).

11. The refrigerant distributor according to claim 10, wherein, in the length direction, with the inlet (31) as the center, the first pre-distributor openings (33) on one side and the other side of the inlet (31) are staggered with respect to the inlet (31).

12. The refrigerant distributor according to claim 1, wherein, the pre-distributor (3*a*) comprises a distribution pipe (32*a*), the inlet (31) being arranged at the top of a pipe wall (321*a*) of the distribution pipe (32*a*), second pre-distributor openings (33*a*) being formed in the pipe wall (321*a*), and in the height direction, distances between at least a part of the second pre-distributor openings (33*a*) and a bottom of the distribution pipe (32*a*) being less than a half of a height of the distribution pipe (32*a*) and greater than zero.

13. The refrigerant distributor according to claim 12, wherein, the pre-distributor (3*a*) further comprises a second cover plate (34*a*) arranged on the upper part of the distribution pipe (32*a*), an area of the second cover plate (34*a*) being larger than a cross-sectional area of the distribution pipe (32*a*) parallel to the length direction.

14. The refrigerant distributor according to claim 12, wherein, the closer to the inlet (31), the larger sizes and/or the larger distribution density of the second pre-distributor openings (33*a*).

15. The refrigerant distributor according to claim 12, wherein, in the length direction, the second pre-distributor openings (33*a*) are asymmetric with respect to the inlet (31).

16. The refrigerant distributor according to claim 15, wherein, in the length direction, with the inlet (31) as the center, the second pre-distributor openings (33*a*) on one side and the other side of the inlet (31) are staggered with respect to the inlet (31).

17. An evaporator, wherein the evaporator (10) comprises the refrigerant distributor (4) as claimed in claim 1;

wherein the evaporator (10) further comprises: an evaporator housing (1), a liquid inlet pipe (2), an air intake opening (9) and a heat exchange tube bundle (5), the refrigerant distributor (4) is located above the heat exchange tube bundle (5), the liquid inlet pipe (2) passes through the evaporator housing (1) and is connected to the refrigerant inlet (41), and the air intake opening (9) is arranged on the top of the evaporator housing (1).

18. The evaporator according to claim 17, wherein, the evaporator (10) further comprises:

a heat exchange tube bundle support plate (6) located under the refrigerant distributor (4) and supporting the heat exchange tube bundle (5);

side baffles (7) located under the refrigerant distributor (4) and at both sides of the heat exchange tube bundle (5); and a mist catcher (8) located between the side baffles (7) and the evaporator housing (1) and supported by the heat exchange tube bundle support plate (6).

19. The refrigerant distributor according to claim 1 wherein, a cross-sectional shape of the box body (42) in a direction perpendicular to the length direction is octagonal.

* * * * *